United States Patent [19]

Gallo

[11] Patent Number: 4,996,471

[45] Date of Patent: Feb. 26, 1991

[54] CONTROLLER FOR AN ELECTROSTATIC PRECIPITATOR

[76] Inventor: Frank Gallo, 188 Crescent Rd., Wanaque, N.J. 07465

[21] Appl. No.: 486,107

[22] Filed: Feb. 28, 1990

[51] Int. Cl.[5] ..... G05F 1/455; B03C 3/68

[52] U.S. Cl. ..... 323/241; 323/244; 323/246; 323/903

[58] Field of Search ..... 323/235, 239, 241, 244, 323/246, 300, 319, 322, 324; 361/235; 363/128; 55/105, 139

[56] References Cited

U.S. PATENT DOCUMENTS

| | | | |
|---|---|---|---|
| 1,934,923 | 11/1933 | Heinrich . | |
| 2,297,841 | 10/1942 | MacKenzie . | |
| 2,462,890 | 3/1949 | Newman . | |
| 2,860,723 | 11/1958 | Wintermute . | |
| 3,059,395 | 10/1962 | Gallaer | 55/105 |
| 3,147,094 | 9/1964 | Hall et al. | 55/105 |
| 3,173,772 | 3/1965 | Gelfand | 55/105 |
| 3,443,361 | 5/1969 | Denning | 55/105 |
| 3,507,096 | 4/1970 | Hall et al. | 55/105 |
| 3,527,022 | 9/1970 | Archer et al. | 55/105 |
| 3,648,437 | 3/1972 | Bridges | 55/105 |
| 3,893,828 | 7/1975 | Archer | 55/104 |
| 4,138,233 | 2/1979 | Masuda | 55/139 |
| 4,152,124 | 5/1979 | Davis | 55/105 |
| 4,290,003 | 9/1981 | Lanese | 323/241 |
| 4,390,830 | 6/1983 | Laugesen | 323/237 |
| 4,410,849 | 10/1983 | Ando | 323/237 |
| 4,486,704 | 12/1984 | Gustafsson et al. | 323/903 |
| 4,502,002 | 2/1985 | Ando | 323/237 |
| 4,587,475 | 5/1986 | Finney, Jr. et al. | 323/903 |
| 4,659,342 | 4/1987 | Lind | 323/903 |
| 4,860,149 | 8/1989 | Johnston | 361/79 |

FOREIGN PATENT DOCUMENTS

| | | |
|---|---|---|
| 0034075 | 2/1981 | European Pat. Off. . |
| 697437 | 9/1953 | United Kingdom . |
| 1129745 | 10/1968 | United Kingdom . |
| 1463130 | 2/1977 | United Kingdom . |
| 1476877 | 6/1977 | United Kingdom . |
| 2012493 | 7/1979 | United Kingdom . |
| 1566242 | 4/1980 | United Kingdom . |

*Primary Examiner*—Peter S. Wong
*Attorney, Agent, or Firm*—Thomas L. Adams

[57] ABSTRACT

A controller can control controlling a precipitator. The controller has a power modulator. The modulator has a control terminal and is coupled to the precipitator. The power modulator is adapted to be powered by an alternating current. The modulator can operate to regulate the drive to the precipitator in response to a control signal on the control terminal. The controller also has a measurement means coupled to the precipitator for providing a plurality of measurement signals corresponding to a plurality of operating parameters of the precipitator. Also included is a processing means having a program. The processing means is coupled to the measurement means and the power modulator for producing the control signal and for regulating the power modulator in response to the measurement signals. The processing means includes a spark concurrence means responsive to at least one of the measurement signals for spark synchronously storing a sparktime signal having a magnitude corresponding to a given one of the operating parameters. The sparktime signal is distinctly stored and designated as a signal occurring during a spark. The processing means can vary the control signal in response to the sparktime signal.

59 Claims, 8 Drawing Sheets

CONTROLLER FOR AN ELECTROSTATIC PRECIPITATOR

BACKGROUND OF THE INVENTION

The present invention relates to controllers for electrostatic precipitators and, in particular, to a controller employing a processing means for storing data.

Known power controllers for electrostatic precipitators measure an operating parameter such as the voltage and/or current at the precipitator. These measured parameters are used to control the power applied to the precipitator. These known controllers employ a microcomputer to measure operating parameters at successive times in a power cycle. Such systems record the measured parameters for subsequent control of the precipitator. See for example U.S. Pat. No. 4,290,003.

Effectively regulating a precipitator with a microcomputer requires assembling data and reacting to its significance. The control points for a precipitator should at times be changed based upon the past experience of the system. Also required for effective control is performance data occurring during a spark. Data thus assembled can be used to compare operation before during and after a spark.

Known microcomputers have interrupt lines, which are triggered by an external process such as the receipt of a message on a communications port. Signalling on an interrupt line can interrupt the main program currently running on the microcomputer. Once interrupted, an interrupt handler, software, diverts the microcomputer to the needs of the interrupting process.

Known precipitator controllers employ integrating circuits to obtain an average of time varying measurements. The additional circuitry, including relatively bulky and expensive capacitors, in electronic integrators lessens system reliability.

Effective control of a bank of precipitators requires detailed information on the operational parameters of each precipitator. Often an upstream precipitator will respond early to a change in gas entering that precipitator. This advance event can alert a downstream precipitators to expect changing gas characteristics.

Accordingly, there is a need for an improved precipitator controller that can act effectively by assembling as much data as necessary to react to its changing environment.

SUMMARY OF THE INVENTION

In accordance with the illustrative embodiments demonstrating features and advantages of the present invention, there is provided a controller for controlling a precipitator. The controller has a power modulator. The modulator has a control terminal and is coupled to the precipitator. The power modulator is adapted to be powered by an alternating current. The modulator can to regulate the drive to the precipitator in response to a control signal on the control terminal. The controller also has a measurement means coupled to the precipitator for providing a plurality of measurement signals corresponding to a plurality of operating parameters of the precipitator. Also included is a processing means having a program. The processing means is coupled to the measurement means and the power modulator for producing the control signal and for regulating the power modulator in response to the measurement signals. The processing means includes a spark concurrence means responsive to at least one of the measurement signals for spark synchronously storing a sparktime signal having a magnitude corresponding to a given one of the operating parameters. The sparktime signal is distinctly stored and designated as a signal occurring during a spark. The processing means can vary the control signal in response to the sparktime signal.

In a related embodiment of the same invention, a different processing means is employed. Rather than storing sparktime signals, this processing means can successively sample sampled ones of the measurement signals over a plurality of half cycles of the alternating current, and to do averaging over the plurality of half cycles. This processing means can detect sparking by detecting in one of the sampled ones a predetermined change in the average from the next half cycle as compared to the average over the plurality of half cycles.

Another related embodiment of the same invention, employs the same power modulator but it now specifically includes a full wave rectifier for converting alternating current to direct current. The rectifier has oppositely phased currents. The same measurement means is used but is now coupled to the rectifier and can make a balance sensing pair of its measurement signals correspond with the oppositely phased currents. A different processing means is employed. Rather than storing sparktime signals, the processing means can disable the control signal in response to a predetermined imbalance in the balance sensing pair.

In another related embodiment of the same invention, the same measurement means is used, but it now makes a voltage sensing one of its measurement signals correspond with precipitator voltage. A different processing means is employed. Rather than storing sparktime signals, the processing means can reduce the control signal in response to the voltage sensing one of the measurement signals falling as the control signal rises in a given manner over a predetermined number of half cycles.

In a related embodiment of the same invention, a different processing means is employed. Rather than storing sparktime signals, this processing means includes timing means coupled to the power modulator for detecting each zero crossing of the alternating current upstream of the power modulator. The processing means cans provide at an operator adjustable time after the zero crossing, an adjusted zero signal. The processing means also includes start means for switching the alternating current on at a time after the adjusted zero signal that is determined by the control signal.

In another related embodiment of the same invention, the same measurement means is used, but it now makes a current sensing one of its measurement signals correspond with precipitator current. A different processing means is employed. Rather than storing sparktime signals, the processing means can turn off the power modulator in response to the current sensing one of the measurement signals exceeding a preset limit for more than a preset time interval.

A related controller of the same invention can also control a precipitator. This controller is operable to communicate with an allied processor. This allied processor can direct another physical process and can transfer information by means of allied signals. The controller has a power modulator with a control terminal and is coupled to the precipitator. This power modulator can regulate the drive to the precipitator in response to a control signal on the control terminal. Also included is a measurement means coupled to the precipitator for providing at least one measurement signal corresponding to an operating parameter of the precipitator. The controller includes a processing means coupled to the measurement means and the power modulator for producing the control signal and for regulating the power modulator in response to the measurement signal. The controller also includes a communications port coupled to the processing means and the allied processor for transferring between them allied signals that are relevant to the precipitator.

In a related embodiment of the same invention, the allied processor and the communications port are not necessarily present. The controller includes, however, an interrupt means coupled to the power modulator for providing to the processing means an interrupt signal. This interrupt signal is responsive to the alternating current for interrupting the program of the processing means and synchronizing the control signal with the alternating current that powers the power modulator.

A related method of the same invention, controls a precipitator and establishes communication with an allied processor. This allied processor can direct another physical process and can transfer information. The method includes the step of measuring at least one operating parameter of the precipitator. Another step is regulating the drive to the precipitator in response to the operating parameter. The method also includes the step of transferring, with respect to the allied processor, information relevant to the precipitator.

By employing apparatus and methods of the foregoing type, improved control of a precipitator is achieved. In a preferred embodiment, the precipitator current is measured when a spark occurs and that current value is decrement a preset amount, to define a new current target. Accordingly, the precipitator is regulated to a current which is floating standard. The standard according to the precipitator current at sparktime.

Also, if the latest precipitator current is within a predetermined range below the current of the last spark, the voltage across an inductor feeding the transformer/-rectifier is monitored. The voltage fluctuations at the inductor under these circumstances signify the imminence of sparking. Inductor voltage fluctuations, however, are only considered significant during the above mentioned range of precipitator current.

In this preferred embodiment, significant parameters such as the precipitator voltage and current are averaged over a number of power cycles, for example, 8 half cycles. This averaged data makes spark recognition reliable. By basing the response on averages, a predetermined jump from these averages is clearly distinguished as a spark. Recent disturbances will not degrade the accuracy of the spark determination.

Also, in this preferred embodiment, a back corona condition can be determined by measuring the precipitator voltage over an operator adjustable number of half cycles. A back corona is declared, if the precipitator voltage is falling while the thyristors drive a transformer/rectifier harder. The ability to examine over a large number of half cycles makes this measurement more reliable.

Also, in some embodiments an inductor in series with the transformer/rectifier causes time lags that make timing the drive thyristors difficult. The preferred embodiment derives a true zero crossing from an operator adjustable time shift that is stored in a microcomputer. Thus, the time at which polarity reverses at the thyristors can be accurately established by allowing a time shift to be applied through the microcomputer. Also this time shift is used to frame the measurement at various points along the cycle of power.

Also in this preferred embodiment, the spark rate is determined by measuring the time between successive sparks. Accordingly, an instantaneous spark rate can be determined by taking the inverse of the time between the last two sparks. This instantaneous spark rate can also be averaged with prior values to provided a smoothed value.

The preferred controller can communicate with allied processors that may be involved in controlling associated precipitators, sulfur trioxide generators and the like. Furthermore, the communications ability of the microprocessor permits monitoring and synchronization of several precipitators by a central monitoring unit. Thus a high degree of coordination among several banks of precipitator is possible.

Also in the preferred embodiment, interrupt signals are obtained from a loop locked in phase to the power line frequency. The loop provides timing signals that are fed as interrupt signals to the microprocessor. Accordingly, the microprocessor can produce switching signals that a power thyristor on and off. The switching signals are accurately timed by the interrupt signals. Also, this preferred embodiment employs gate turn-off thyristors. These thyristors can be positively turned off even with a substantial potential across the thyristor. This feature expands the possible control modes for the precipitator.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings, wherein.

DETAIL DESCRIPTION OF THE PREFERRED EMBODIMENTS

Figure 1:
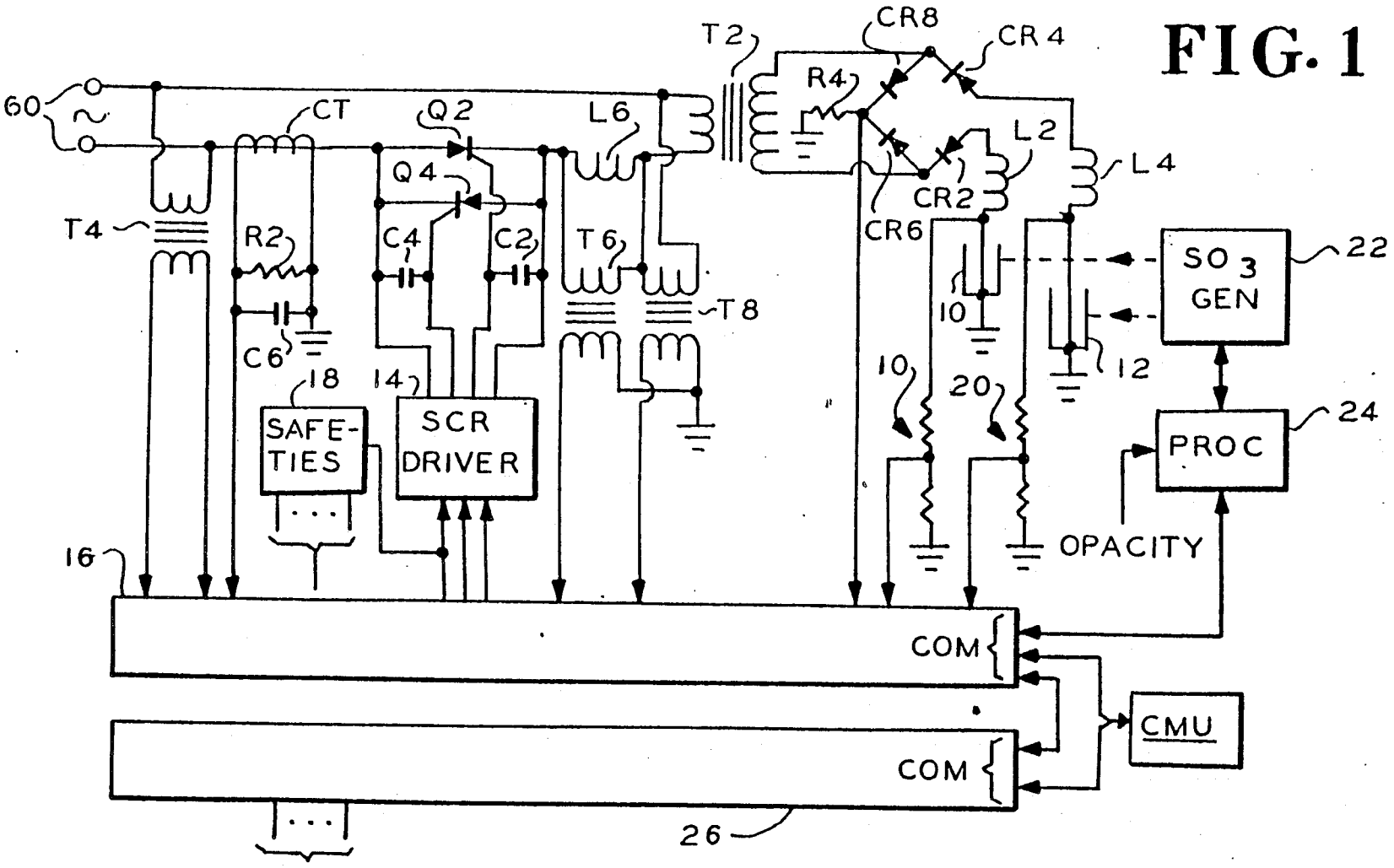
FIG. 1 is a schematic diagram of a precipitator, allied processor and controller in accordance with principles of the present invention.

Referring to FIG. 1, a pair of precipitators 10 and 12 are shown connected between ground and one of the terminals of inductors L2 and L4, respectively. The other terminals of inductors of L2 and L4 are separately connected to the anodes of rectifiers CR2 and CR4, respectively. The cathodes of rectifiers CR2 and CR4 connect to the anodes of rectifiers CR6 and CR8, respectively, whose cathodes are commonly connected through resistor R4 to ground. The anodes of rectifiers CR6 and CR8 separately connect to the secondary of transformer T2, whose primary is serially connected to power lines 60 through inductors L6 and L8 and the antiparallel combination of gate turn-off thyristors Q2 and Q4. Thyristors Q2 and Q4 are called herein a switching means within a power modulator.

A pulse on the gates of thyristors Q2 and Q4 can cause them to start or stop conducting. Every terminal of thyristors of Q2 and Q4 separately connect to outputs of thyristor driver 14. Driver 14 has the appropriate buffers and amplifiers to drive the gates of thyristors Q2 and Q4. Each of the thyristors Q2 and Q4 has a shunting capacitor C2 and C4, respectively, connected from gate to cathode.

Control signals are shown as inputs to driver 14 from processing means 16. One of these control signals is connected to safety circuit 18 to incapacitate driver 14. The safety 18 includes a series of switching elements such as a thermal cut-offs located at various heat generating elements. Each of these safeties can be enabled by enabling signals from processing means 16, which will be described in further detail hereinafter.

Connected in parallel across current transformer CT are resistor R2 and capacitor C6, which provide a primary current signal to processing means 16. Another two inputs to processing means 16 separately connect to the alternating power lines 60 through signal transformer T4. Similarly, signal transformers T6 and T8 connect the voltage across inductor L6 and the primary of transformer T2 to separate inputs of processor means 16. The current through the bridge comprising rectifiers CR2–CR8 flows through resistor R4 whose voltage is provided as an input to processing means 16. Also, precipitators 10 and 12 are in parallel with resistive voltage dividers 18 and 20, respectively, whose taps separately connect to inputs of processing means 16.

In this embodiment, precipitators 10 and 12 are conditioned by sulfur trioxide generated by plant 22. Plant 22 can be a combined sulfur burner and converter of the type described in U.S. Pat. Nos. 4,770,674 and 4,844,723, whose disclosures are incorporated herein by reference. The sulfur trioxide output from plant 22 can be controlled by allied processor 24 in response to the illustrated opacity input or by other parameters, such as measurements made by processing means 16 and communicated to processor 24 in a manner to be described presently. Processor 24 may be of the type described in the last two mentioned patents, but modified to incorporate the communications feature to be described presently for processor 16.

Processing means 16 can independently control the power delivered to precipitators 10 and 12. The various parameters measured by processing means 16 can be analyzed by its program to set the drive desired. For example, the system responses described in U.S. Pat. No. 4,290,003 can be used. As a minimum, excessive voltage measured either at dividers 18 or 20, or transformers T4, T6, or T8, or inductor L8 can be used to reduce the drive through thyristors Q2 and Q4.

As explained in the above mentioned patent, the conduction angle of thyristors Q2 and Q4 establishes the power delivered through transformer T2. For example, during one half cycle, thyristor Q2 can be kept off until a certain phase angle is reached, at which point a pulse is applied to its gate to turn the thyristor on for the balance of the half cycle. In the next half cycle, a similar operation can be performed with respect to thyristor Q4.

It will be appreciated, however, that thyristors Q2 and Q4 can be turned off before the end of a half cycle. This turn-off can be done to regulate finely or to respond to a catastrophic event such as a spark or back corona condition. Accordingly, a back corona, a spark or the imminence of either can be sensed and used to immediately remove power.

Processors 16 and 24 are enhanced with communications capability as indicated by their interconnected communications ports COM. Port COM is also shown communicating to another allied processor 26. Processor 26 can be identical to processing means 16 and be used to control another precipitator (not shown) that is upstream (or downstream) from precipitators 10 and 12.

The communications from port COM can be in the form of serial data bits using the RS-232 or other protocol. Data is exchanged with a central monitoring unit CMU shown connected to the communications ports COM of processors 16 and 26. Central monitoring unit CMU can be a personal computer that is programed to send and receive data from processors 16 and 26. For example, unit CMU can by or without request receive data signifying operating parameters measured by processing means 16. These various operating parameters can be displayed on a CRT (not shown) in unit CMU. Thus a remote operator can monitor all significant parameters associated with precipitators 10 and 12 and its transformer-rectifier.

Also, the waveforms of the various monitored operating parameters can be displayed at unit CMU. For example, voltage measurements from divider 18 can be sampled at successive times during a half cycle of power line 60. After collecting data samples, communications port COM of processing means 16 can transmit the samples in a burst to unit CMU. Unit CMU can assemble the data and display them graphically as a waveform. In addition, characteristics of the waveform can be calculated either in unit CMU or at processing means 16. For example, the average, peak, minimum, RMS or other characteristic of an operating parameter measured by processing means 16 can be numerically displayed by unit CMU.

The software can cause intermittent energization by gating the thyristors at the duty cycle desired. Parameters can then be measured and averaged over individual half cycles, to allow display of the applied voltage and current over half cycles that have either full or reduced power.

Since average values can be calculated internally through the program of processing means 16, discrete analog integrators are unnecessary for filtering data, as was done in the past.

Also in some embodiments, operating parameters measured by processor 26 can be sent either to unit CMU or to processing means 16. For example, an upstream precipitator regulated by processor 26 can reveal an increased consumption of power, indicating relatively dirty combustion gas in the upstream precipitator. This advance information can be communicated to processing means 16 to cause it to increase its drive to precipitators 10 and 12, in anticipation of the arrival of dirtier gas.

There can also be active communications between processing means 16 and processor 24 controlling sulfur trioxide generator 22. For example, the drive to precipitator 10 and 12, as controlled by processing means 16, can be coordinated with the sulfur flow rate produced by generator 22. As a minimum, both systems can be turned on and off together Also, a change in opacity or other parameter sensed by processor 24 can be communicated to processing means 16. An increase in opacity can alert processing means 16 to increase the drive to precipitators 10 and 12. Also, the amount of power supplied to precipitators 10 and 12 can be communicated as data from communications port COM of processing means 16 to processor 24. A change in such power can be used to alter the sulfur flow rate from sulfur trioxide generator 22.

In some embodiments, the communications between processor 24 and processing means 16 can initiate a test cycle. For example, a command from processor 24 received by processing means 16 can cause the drive applied through thyristors Q2 and Q4 to fall gradually. During this decline, the voltage and current through transformer T2 can be measured at given sampling rate. The resulting ordered pairs defines the V-I characteristic, and thus the operating conditions of precipitators 10 and 12. These data can be returned to processor 24 through communications port COM so appropriate action can be taken. This information can be used to determine whether precipitators 10 and 12 need more or less sulfur trioxide.

Figure 2:
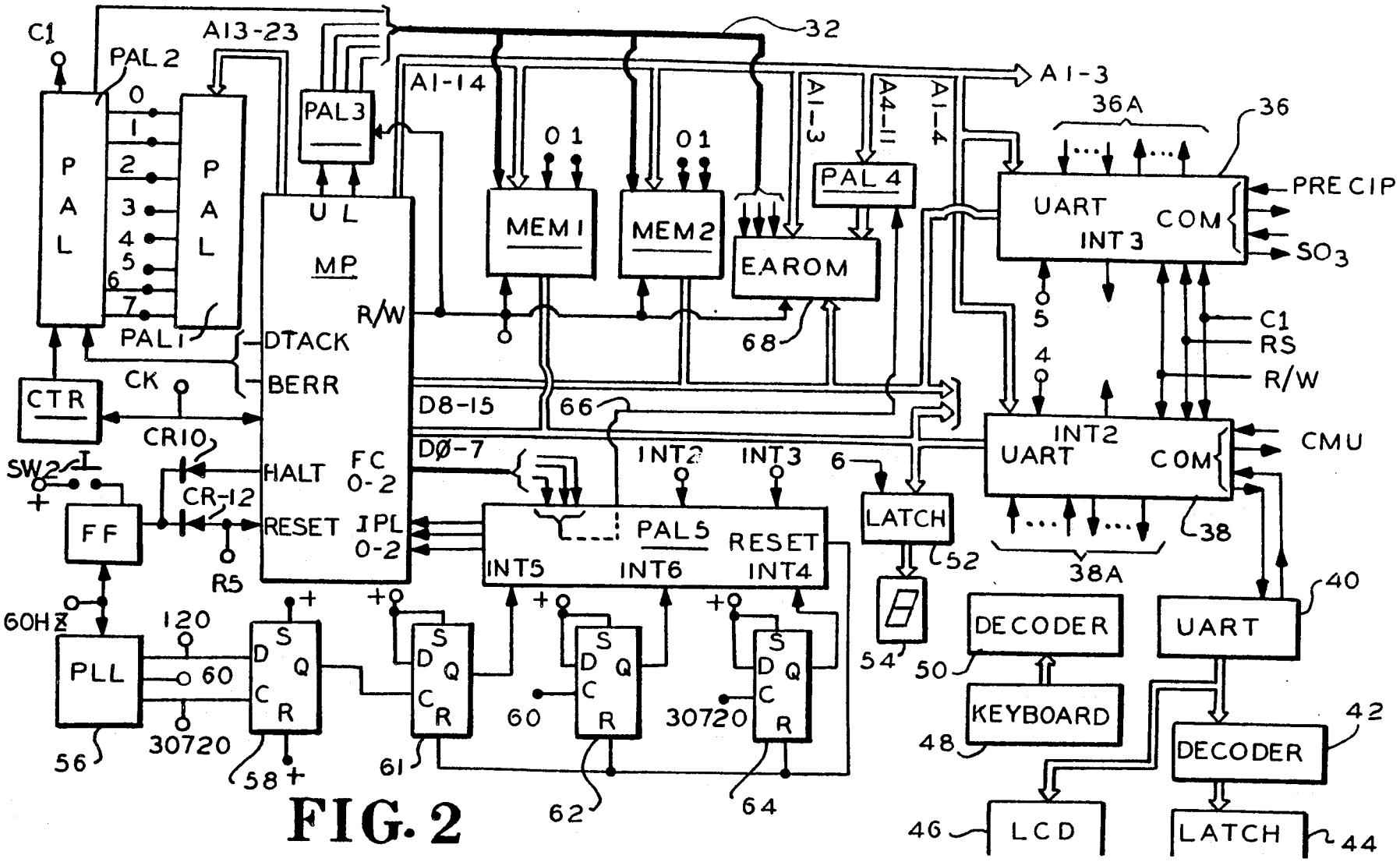
FIG. 2 is a more detailed block diagram of the controller of FIG., 1.

Referring to FIG. 2, previously illustrated processing means 16 is shown in further detail. The illustrated microprocessor MP is Motorola type SCN68000, having 16 data bits and 23 address bits. The address lines are shown as group Al-14 and group A13-23. The data lines are shown as groups D0-7 and D8-15.

A 60 Hz signal is shown connected to flip flop 30, which is also connected through reset switch SW2 to a positive potential. Pressing switch SW2 cause flip flop 30 to apply a resetting signal, in synchronism with the 60 Hz signal, at the junction of the cathodes of diodes CR10 and CR12, whose anodes separately connect to the halt and reset lines of processor MP. The resetting signal at the anode of diode CR12 is identified as resetting signal RS, and is employed in other places in this schematic.

Address lines A13-23 are connected to a programmable array logic unit PAL1. The output designations 0–7 of unit PAL1 are used throughout this schematic and, in particular, lines 0, 1, 2, 6, and 7 connect to separate inputs of programmable array logic unit PAL2. Unit PAL2 also receives inputs from terminals DTACK and BERR of microprocessor MP. Unit PAL2 is also connected to the output of a clock counter CTR. Counter CTR is driven by a clock signal applied to terminal CK, which also connects to the clock input of microprocessor MP. The inputs of unit PAL2 determine the state of output C1. Bank outputs U and L and the read/write output R/W of microprocessor MP connect to separate inputs of programmable array logic unit PAL3. Units PAL2 and PAL3 have together the illustrated five outputs which are combined into control line 32. Control lines 32 are used to enable various memory devices that will be described presently.

Units PAL1, PAL2 and PAL3 are much like nonvolatile memory devices that can be preprogrammed by the original equipment manufacturer. In this system they are programed to produce outputs as if they were combinational logic circuits for establishing the various machine states. Units PAL1 and PAL3 are Signetics type PLS163, and unit PAL2 is Signetics type PLS161, although other types can be used instead.

RAM and ROM type memory is employed in units MEM1 and MEM2. The ROM type memory includes the programming that will be described presently for controlling microprocessor MP. In one constructed embodiment, each unit had a pair of RAM memory chips, generic type 6516, and a pair of ROM memory chips, Motorola type 2764. It will be appreciated, however, that the amount of memory can be altered, depending upon the number of functions and the complexity of operations to be performed by processor MP.

The signals from lines 32 applied to inputs 0 and 1 of units MEM1 and MEM2 select the specific memory bank. The data lines of memory units MEM1 and MEM2 are separately connected to data buses D0-7 and D8-15, respectively. Units MEM1 and MEM2 are also connected to read/write output R/W of microprocessor MP.

Address lines Al-4 are shown connected to dual universal asynchronous receiver/transmitters (UART's) 36 and 38, which are preferably Motorola type SCN-68681, although other types can be used instead. Devices 36 and 38 are typically supplemented with various current drivers, buffers, and opto-isolators to provide an useable interface to digital inputs and outputs 36A and 38A, respectively. The signals on lines 36A and 38A can be considered switching signals to control various devices such as power contactors. One series of significant outputs are the switching signals applied to the previously illustrated thyristor driver (driver 14 of FIG. 1). Other switching outputs are the enabling signals applied to the previously illustrated safeties (safeties 18 of FIG. 1). Furthermore, any other switched control needed by the system can be handled through the outputs of lines 36A and 38B.

Also, the outputs 36A and 36B from devices 36 and 38 can be switched at a desired duty cycle to represent an analog signal. The timing of this duty cycle can be timed by the interrupt signals describe hereinafter. The interrupt can start an interrupt handler that checks whether an analog signal is needed and establishes the timing appropriate for this periodic signal. Accordingly, the program can set and reset a latch at the appropriate duty cycle. The resulting, periodically varying signal can be filtered by an active filter to produce an averaged output signal. This technique accomplishes a digital to analog conversion simply. The analog signal can be used for various purposes where an analog signal is used to control a function. Also the output can be used to drive an analog meter.

Binary inputs are also gathered through lines 36A and 38B and may include signals confirming operation of certain relays or contactors or sensing the state of the previously mentioned safeties.

The devices 36 and 38 connect to, are enabled by and synchronized by previously mentioned: enable signal C1, the resetting signal RS and the read/write signal R/W. Each of the devices 36 and 38 have a pair of serial ports COM. Also, devices 36 and 38 produce their own interrupts INT3 and INT2, respectively. These interrupts coordinate the flow of information on serial ports COM.

Device 36 is shown with one port COM connected to the previously mentioned precipitator (allied precipitator controller 26 of FIG. 1). The other port COM of device 36 is shown connected to previously mentioned sulfur trioxide generator S03 (generator 22 of FIG. 1). One port COM of device 38 is shown connected to previously mentioned unit CMU (FIG. 1). The other port COM of device 38 is shown connected to another UART, preferably General Instruments type AY-3-1015D, although other types can be used instead. Device 40 is shown driving decoder 42, for example, a Signetics type PLS163. The output of decoder 42 is stored in a latch 44 having several binary outputs. The outputs of latch 44 are connected to various annunciators in the form of light emitting diodes (not shown). These annunciators can indicate power on/off, test functions, resetting and other functions associated with the functional states of the machine.

The output of UART 40 is also connected to a liquid crystal display 46 for providing visual information. For example, prompts or parameter values can be exhibited through display 46. Decoder 50 is driven by keyboard 48, much like a telephone keypad; although in some embodiments a full alphanumeric keyboard may be used. Decoder 50 provides input signals to device 40. Consequently, keyboard 48 can provide information through port COM of device 38 to microprocessor MP. In the reverse direction, data along lines DO-7 is transferred through devices 38 and 40 to latch 44 to display various signal lights.

Latch 52 is connect to data bus DO-7 and enabled by line 6 from unit PAL1. Latch 52 can be loaded with a number which is displayed in display 54. This displayed number can be used diagnostically by technician who may be troubleshooting the board.

The other equipment in FIG. 2 is associated with providing an interrupt means. In particular, the 60 Hz signal is applied to the input of phase locked loop 56, which in the usual fashion produces a three signals synchronized to line frequency, in particular, signals 60, 120 and 30720 at 60 Hz, 120 Hz and 30720 Hz, respectively. The latter two signals are connected to input D and C, respectively, of flip flop 58 whose set and reset terminals are connected to positive potential. The output Q of flip flop 58 connects to clock input C of flip flop 61.

The signals 60 and 30720 from loop 56 also connect to clock inputs C of flip flops 62 and 64, respectively. The D and S inputs of flip flops 61, 62, and 64 are all connected to positive potential. The Q outputs of flip flops 61, 62 and 64 connect to inputs INT5, INT6 and INT4 of unit PAL5.

Unit PAL5 is a programmable array logic unit, for example, Motorola type PLS161. Unit PAL5 signals an interrupt hierarchy which determines which of several competing interrupt signals is serviced first. Accordingly, the interrupt signal INT2 and INT3 from devices 36 and 38 are also shown as inputs to unit PAL5. Unit PAL5 cycles to produce the reset output shown connected to each of the reset inputs R of units flip flop 60, 62 and 64. Unit PAL5 is programed to assign a priority to the competing interrupts, and to signal the highest priority on inputs IPL0-2 of microprocessor MP.

Flip flops 60, 62 and 64 are arranged to provide signals at 120 Hz, 60 Hz and 30,720 Hz, respectively. These various signals are timing signals which microprocessor MP needs in order to monitor and control the precipitators. For example, the process may place a very high priority on being aware of a zero crossing, as indicated by flip flop 61, as well as the end of a cycle indicated by flip flop 62. The relatively high speed signals from flip flop 64 are used to synchronize other signals.

Also, the timing signals provided at 30,720 Hz establishes 256 sampling points in each half cycle, for high resolution. The data can be read point by point or averaged over one half cycle, for accurate measurement of conditions in each half cycle of operation. The point at which zero crossing of the line frequency is sought is adjustable through software, allowing each of the inputs to be framed precisely in each half cycle, regardless of the delay (phase shift) generated by a linear reactor or the capacitance of the precipitator under control. Average values may be converted to RMS based on the firing angle of the thyristors.

The analog information can be stored in memory as 128 points of each analog input waveform for each half cycle, although in some embodiments employing faster components, 256 or more points can be stored. This allows display of a signal on a remote or local display, after a burst of data.

The occurrence of communications signals noted by interrupt signals INT2 and INT3 from devices 36 and 38, can have a different priority. Interrupt signals on lines INT2 and INT3 indicate that data is available from devices 36 and 38.

The transmission of an interrupt signal on lines IPL0-2 cause microprocessor MP to interrupt its normal program and send an inquiry signal from outputs FC0-2 to the illustrated inputs of unit PAL5. Essentially, the unit PAL5 responds by sending an output on line 66 to an input of programmable array logic unit PAL4 to enable it. Unit PAL4, a Signetics type PLS163, is programed so that when microprocessor MP requests an interrupt vector along lines A4-11, the outputs of unit PAL4 connected to memory unit 68 are all high.

Unit 68 is an electrically alterable, read only memory (EAROM), for example SEEQ type 2816. Unit 68 is nonvolatile but can have its memory contents altered in a known way. Memory 68 can be enabled by the appropriate control lines in lines 32. Consequently, when a corresponding address is applied through lines Al-3, memory 68 is able to return the appropriate interrupt vector along bus D8-15.

Accordingly, device 68 can be programed to provide an initial interrupt vector that is appropriate at start up, at the half and full cycle points, upon receipt of serial data etc. The interrupt handler can be contained in software in memories MEM1 or MEM2. If contained in RAM the handler can be altered on the fly by programming contained in the memory units MEM1 and MEM2. This provides a maximum amount of flexibility so that the microprocessor MP can have a flexible response to interrupts, which varies over time.

Figure 3:
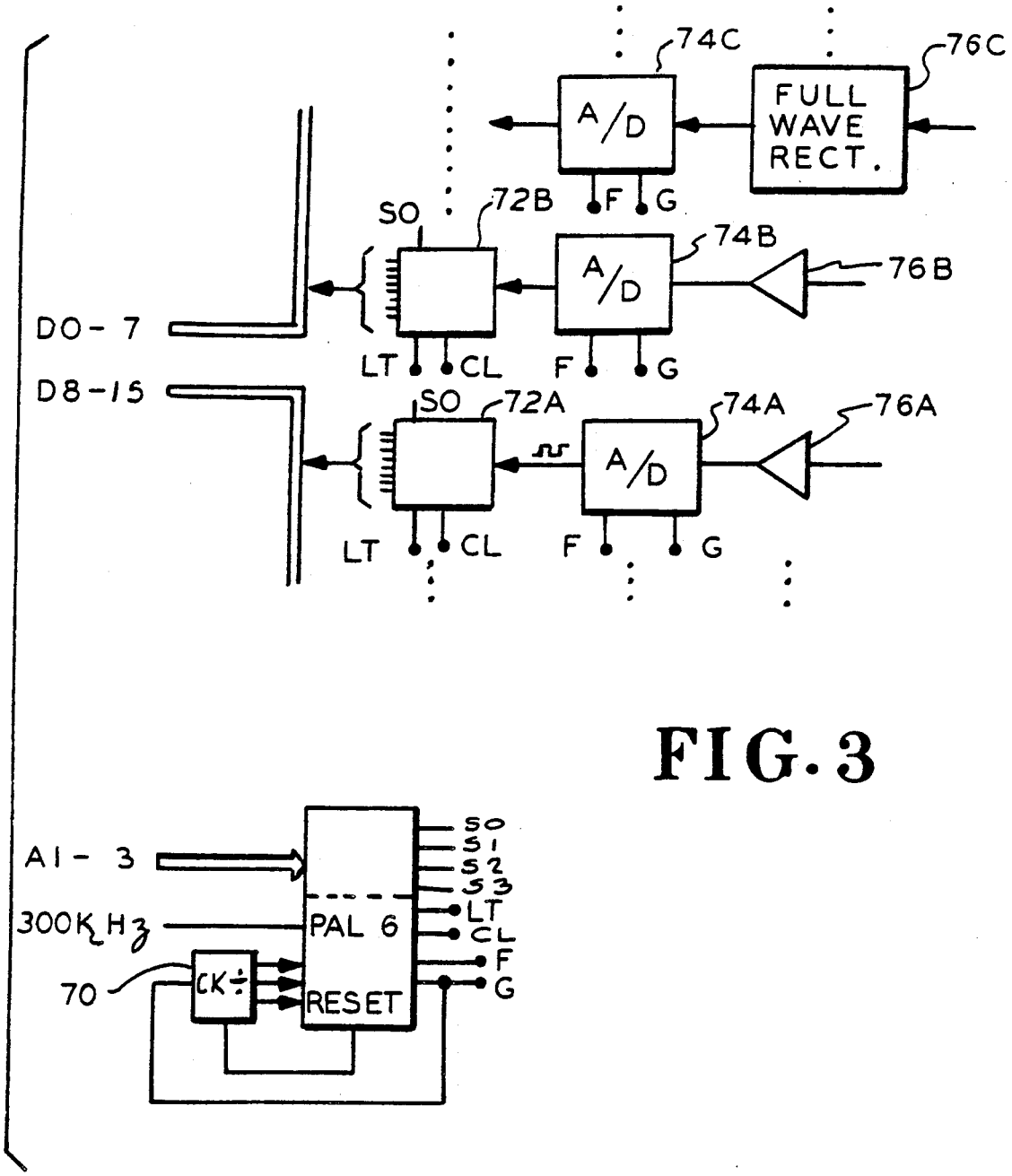
FIG. 3 is a block diagram of an analog signal measuring system coupled to the data and address lines of the controller of FIG. 2.

FIG. 3 shows previously illustrated address lines Al-3 and data busses D0-7 and D8-15. Address lines Al-3 are shown connected to a programmable array logic unit PAL6 to determine the illustrated outputs on lines S0, Sl, S2 and S3. These outputs are enabling signals to activate various input and output devices.

Unit PAL6 also is driven by a 300 kHz signal to produce outputs LT, CL, F and G. Output G is fed back to the clock input of divider 70. Binary divider 70 has a three bit output, which is applied to three inputs of unit PAL6. A resetting output from unit PAL6 is coupled to the reset input R of divider 70. Accordingly, unit PAL6 can be used a general purpose, multiple state machine for timing events within the resolution of the period of the 300 kHz signal. In particular, outputs LT and CL connect to a tristate latch/shift register 72A, shown herein as a Motorola type 74HC595. A pulse train of a variable length is provided from analog to digital converter 74A, which is enabled by previously mentioned inputs F and G. Buffer 76A applies to converter 74 the analog signal measured by it. In operation, an analog signal from buffer 76A causes converter 74A to provide a pulse train when enabled by inputs F and G. The pulse train is counted by shift register 72A, when enabled by previously mentioned control signals LT and CL. The microprocessor indicates a need for information from the units of FIG. 3, by sending an address on bus Al-3, which triggers one of the control lines, for example line S0. Accordingly, an enable signal on line S0 causes the latches of register 72A to send its data along bus D8-15.

The dots below units 72A, 74A and 76A indicate that similar units can be connected in parallel on bus D8-15.

Units 72B, 74B and 76B correspond to and function the same as previously mentioned units 72A, 74A and 76A, respectively, but communicate on bus D0-7. The dots above unit 72B indicate that similar units can be connected in parallel on bus D0-7. Converter 74B is shown replaced with a converter 74C that is identical except for being driven by a full-wave rectifier 76C, not a buffer. Unit 76C can have a full-wave bridge of the usual type and with filtering so that alternating signals on the input of unit 76C are applied to converter 74C as a direct current signal.

OPERATION

To facilitate an understanding of the principles associated with the foregoing apparatus, the operation of the units of FIGS. 1, 2, and 3 will be described in connection with the flowchart of FIGS. 4A–F. In this flowchart, various regulating parameters are identified with a label having the prefix "P". These parameters are stored in memory and affect the way in which the program operates. It is to be understood that these parameters throughout the flowcharts can be varied by an operator. In step 100 of FIG. 4A these parameters are set to a default value or to the value previously selected by an operator. In step 100 hardware such as the ROMs and UARTs are also checked. Additionally, interrupt vectors are established at this time. The check sum of parameter P39 is now used to verify the integrity of the programs contained in ROM. An error message is displayed if the check sum is not confirmed.

Phase reversals can occur when wiring phase sensitive circuitry. Thus, incorrect power phase information may be sent to microprocessor MP. To avoid an out-of-phase condition, parameter P33 can be used in step 102 to change the polarity determination made by the associated phasing circuitry. Also, the reactors L6 and L8 (FIG. 1) may create a time delay so that the zero crossing as measured at terminal 60 (FIG. 1) may be different from the zero crossing as seen by transformer T2. For this reason, parameter P31 represent a time shift that is read in step 102 to offset the zero crossing determined by phase locked loop 56 (FIG. 2).

In step 104, a software timer determines whether it is time to refresh the display. As disclosed hereinafter, data is averaged so that the display show the data trends according to the refresh rate. The refresh rate can be set by the operator through parameter P30. If time to refresh, in step 106 the data is averaged in this example, over 8 power half cycles. In particular, 256 samples are taken over the half cycle of variables such as the precipitator voltage and current, to obtain an average value. Next, the eight most recent averages taken over the last eight half cycles are then averaged together to provide a long term average. In step 108, according to the operator adjustable parameter P45, microprocessor MP can calculate the RMS value of the primary voltage and current. In step 110, that RMS value and the other averages are stored.

In step 112, the various data are displayed in accordance with the operator adjustable parameters. The parameter P29 determines whether the spark rate will be shown as an averaged or instantaneous value, as will be defined further hereinafter. Parameter P35 determines whether the secondary current will be shown as two opposite phase values or a combined value. Parameter P34 determines if one or two precipitators is connected and therefore whether dual bushing readings are needed. Parameter P32 indicates whether the system is operating in a pulse modulated power (PMP) mode. In such a mode, the power can be pulsed to a relatively high value for a preset number of half cycles. Thereafter, the power can remain off (or low) for a predetermined number of half cycles. In a typical display, the information is displayed as follows:

| SEC VOLTS | | SEC CURR | | PRIMARY | | SPARK | ALARM |
|---|---|---|---|---|---|---|---|
| HVA | HVB | IA | IB | VP | IP | S/M | STATUS |
| 40.5 | 40.2 | 500 | 500 | 180 | 120 | 40 | ON |
| PMP DISABLED | | | | ALARM MESSAGE | | | |

In step 114, an on/off annunciator can be displayed and in step 116 various relays can be operated through UARTs 36 and 38 (FIG. 2). These relays can operate alarms or buzzers or certain subsidiary equipment. For example, parameter P28 can be set to operate a relay upon an under voltage condition. If not set, this relay can be energized for any alarm condition. Also, at this time in step 116, the contractors supplying power to the precipitators can be turned on and off depending upon flags and alarms set in steps described hereinafter. Also, at this time alarm messages can be displayed on the liquid crystal display 46 (FIG. 2).

In step 118, the processor determines whether the ash level from the precipitator is high and if high, in step 122 alarm flags and an off flag are set to display the alarm data and switch off the power contactors in the manner just described. Next, in step 124, microprocessor MP determines whether a remote unit such as central monitoring unit CMU (FIG. 1) is present and in step 126 the microprocessor determines whether the unit is on.

In step 128, the microprocessor compares the voltage across resistor R4 (FIG. 1) in different half cycles. If the voltage is greater in one half cycle than the other by an amount established by parameter P26, this unbalanced condition sets an alarm flag in step 130. A large current imbalance suggests that one of the precipitators is either shorted or an open circuit.

Figure 4A:
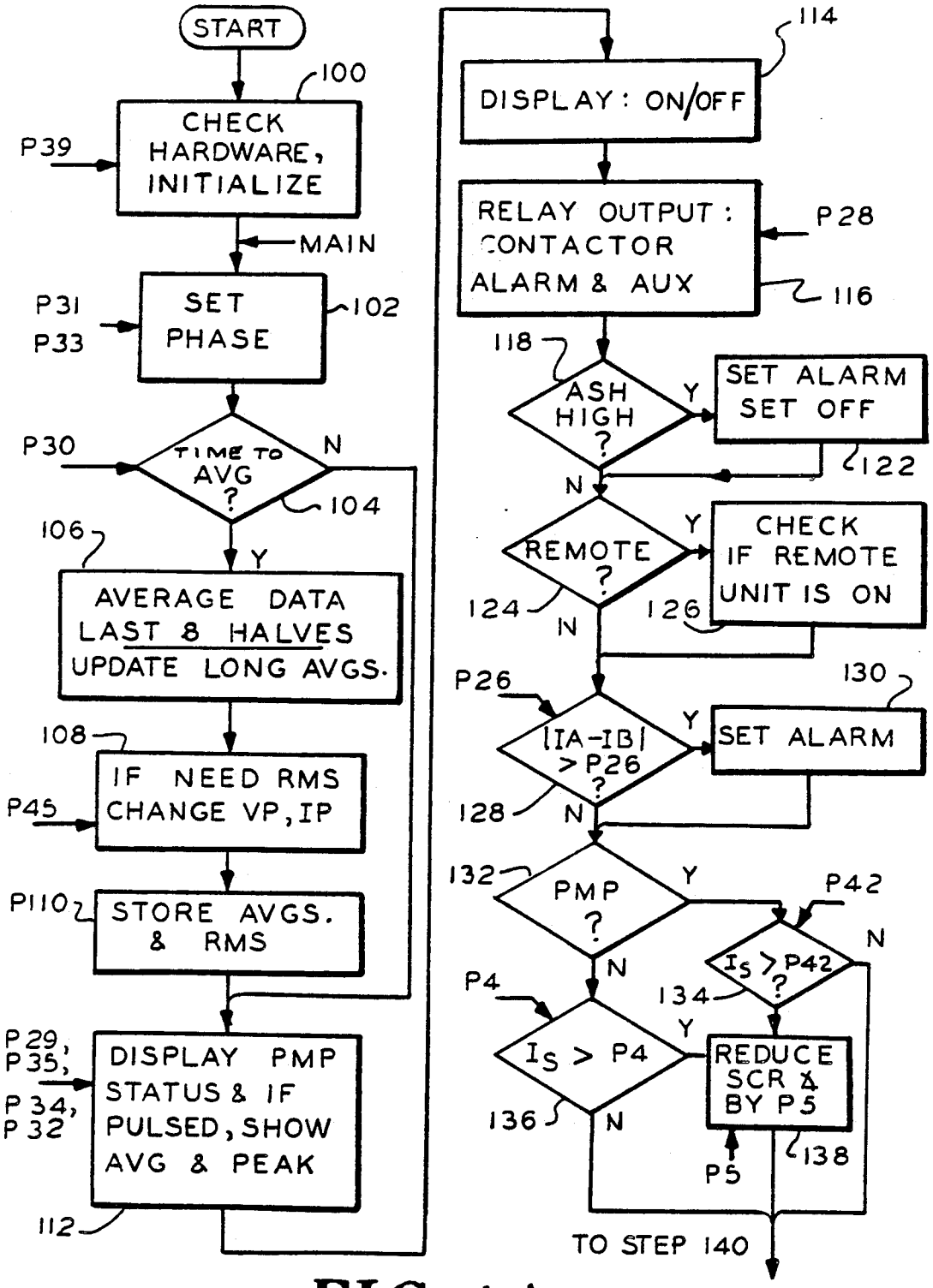
FIGS. 4A–F are flowcharts illustrating the software associated with the processor of FIG. 2.
Figure 4B:
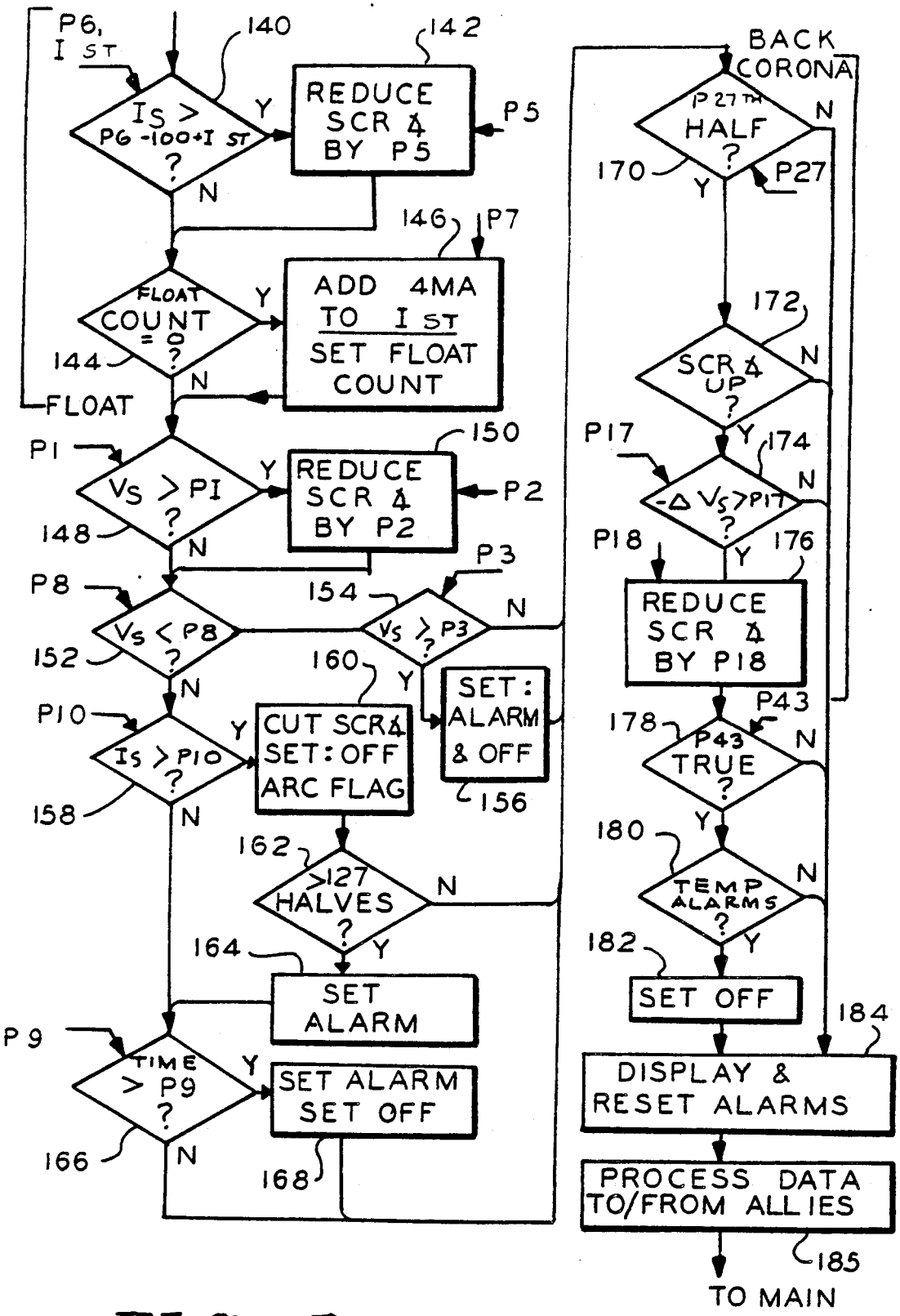

In step 132, the processor determines whether the system is working in the pulse modulated power mode. If not, in step 136 the precipitator current is compared against operator adjustable parameter P4. If the parameter P4 is exceeded, in step 138 the conduction angles of thyristors Ql and Q4 (FIG. 1) are reduced by operator adjustable parameter P5. Thereafter control is transferred to step 140 (FIG. 4B). If not in the pulse modulated power mode, the precipitator current is compared against operator adjustable parameter P42. If exceeded, the thyristors are also reduced by parameter P5 in step 138. Thereafter (or if neither parameter is violated), step 140 of FIG. 4B is executed.

Referring to FIG. 4B, steps 140–146 constitute a floating current control. Specifically, the precipitator current is regulated against a standard that varies depending upon the precipitator current when a spark occurs. A spark detection subprogram will be described hereinafter. When a spark occurs, the precipitator current during the last eight half cycles before sparking occurs is separately stored and designated as sparktime current, $I_{st}$. Accordingly, in step 140 the present precipitator current $I_s$ is compared against the spark-time precipitator current $I_{st}$, but increased by an operator adjustable parameter P6, less 100. If the precipitator current exceeds this limit, in step 142 the thyristor angle is decreased by operator adjustable parameter P5.

Thereafter (or if the standard is not violated), in step 144 a memory location is examined to determine whether a previously stored float count has expired. In step 144, the float count is decremented and compared against zero. If zero, in step 146 the float count is preset to operator adjustable count P7. Also in step 146, the sparktime current $I_{st}$ is fictitiously increased by 4 mA. This means that the regulation standard for precipitator current is increased after a certain number of spark-free half cycles. Thus this feature allows the standard to increase unless a spark occurs, at which time sparktime current $I_{st}$ is revised to its actual value.

In step 148, the precipitator voltage measured across dividers 18 and 20 (FIG. 1) are compared against an operator adjustable parameter Pl. If violated, the thyristor angle is reduced by operator adjustable parameter P2. Thereafter, in step 152 the precipitator voltage is compared against an undervoltage standard determined by operator adjustable parameter P8. If an undervoltage condition does not exist, in step 154 the precipitator voltage is compared against an overvoltage trip value determined by operator adjustable parameter P3. If this trip value is exceeded, in step 156 an alarm flag is set and an off flag is set. After executing step 156 (or if skipped after step 154), step 170 is performed.

If an under voltage condition is determined in step 152, in step 158 precipitator current is compared against parameter P10. If violated, in step 160 the thyristors are cut back and an off flag and arc flag are set. The foregoing condition was an extreme, arcing condition. Consequently, it will take several cycles for the effect of the arc to subside. If the arc does not subside, however, this indicates that there is major failure. Accordingly, in step 162, the number of successive passes are counted in terms of half cycles. If there are fewer than 127 passes, step 170 is executed. If, however, the arc-like condition persist for greater than 127 half cycles, an alarm is set in step 164.

If an arc is not detected, however, step 158 is succeeded by step 166, wherein a timer is started to determine how long the program cycles through this section. Such cycling indicates a persistent undervoltage condition. The allowable elapsed time is set by parameter P9. If in successive passes through branch 166, time P9 expires, an alarm is set in step 168.

The following steps 170–176 constitute a subprogram for monitoring back corona. In step 170, the number of half cycles elapsing since the last back corona test is compared against parameter P27. Accordingly, a back corona check is performed every P27 half cycles. If in the P27th half cycle, step 172 is executed to determine whether the thyristor angle has been progressing upwardly over the last P27 half cycles. The program can be set to check whether the: (a) the earliest recorded thyristor angle is less than the current thyristor angle; (b) whether each successive thyristor angle is successively greater; or (c) whether the present thyristor angle is greater than the average thyristor angle over the last P27 half cycles. Step 174 next determines whether the precipitator voltage has decreased by an amount exceeding parameter P17. The manner of determining the activity over the last P27 cycles can be done in a manner similar to the evaluation of thyristor angle in step 172. If steps 170, 172 and 174 are all affirmative, then the thyristor angle is reduced according to parameter P18 in step 176. If any one of the steps 170–174 are negative, step 176 is skipped and control advances to step 184. If all are positive step 178 is executed.

Steps 178 and 180 determine whether temperature alarms are to be evaluated, if demanded by parameter P43. Thus in step 180, an excessive temperature in the cabinet housing the thyristors or other components can set an alarm. The violation sets an off flag in step 182.

In step 184, all of the alarms that were set in the prior steps are sent to display 46 (FIG. 2). Any alarms that are no longer violated are reset in this step.

The following step 185 handles data recently received from, or new instructions to be transferred to, allied processors, such as processors 24 and 26 of FIG. 1. The data exchanged and the anticipation routines were previously described in connection with the allied processors. These routines are handled at this point and decisions to act upon or send additional data to processors is made at this juncture. Thereafter, the program returns to the main branch (FIG. 4A) to repeat this cycle.

Figure 4C:
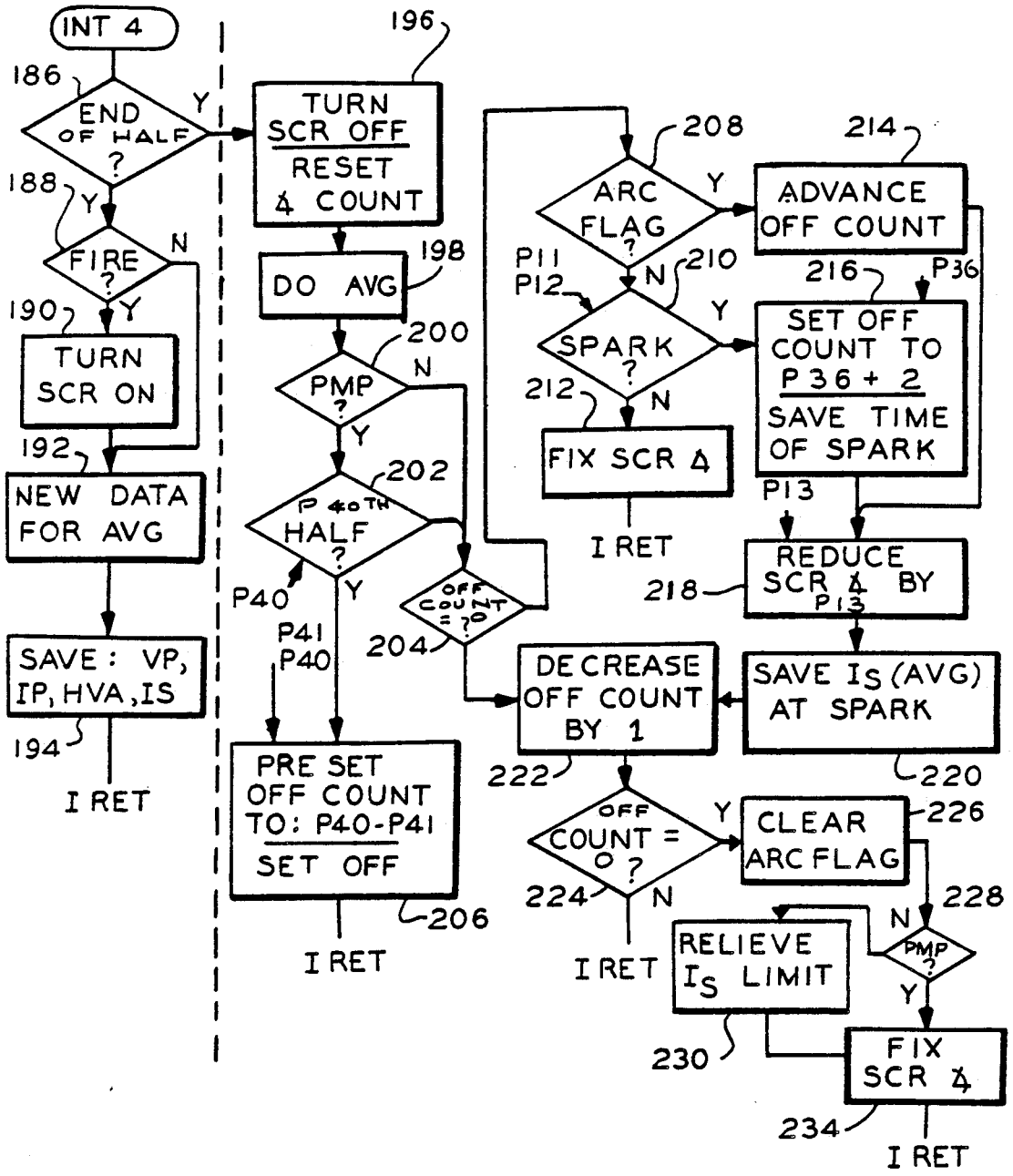

FIG. 4C illustrates an interrupt handler. As previously described, a phase locked loop 56 (FIG. 2) times the end of a full cycle ½ of a cycle and 1/256 of a half cycle. This figure illustrates the handler operating at every 1/256 of a half cycle. Step 186 determines whether the half cycle has just ended. If not, step 188 determines whether the thyristor firing angle stored in memory has been reached. If so, the thyristor is turned on in step 190. In step 192, a new set of data is gathered for purposes of subsequently developing a half cycle average. This data is saved in step 194. Thereafter, the interrupt handler ends and control is returned to the program of FIGS. 4A and 4B.

If, however, this interrupt handler is called at the end of a half cycle, control immediately diverts to step 196 where the thyristors are turned off and the angular count is reset. In step 198, all of the data accumulated over the prior half cycle are averaged.

In step 200, control is transferred to step 202 if the system is working in a pulse modulated power mode. In step 202, the system determines whether P40 power half cycles have passed in the current PMP period. If the P40th half cycle has been reached, in step 206 the thyristors are turned off and an off is count is set to the difference between parameters P40 and P41.

If a pulse modulated power mode is not occurring, or if it is not the end of a cycle of such a process, in step 204 the off count is checked. The off count is set in subsequent steps to indicate the number of power half cycles for which power should be kept off. If the off count has not finished, the off count is decreased by one in step 222.

Otherwise, in step 208 the arc flag is checked, and if set, in step 214 the off count is advanced to a number of power half cycles appropriate to handle an arc. Step 218 follows thereafter. If there is no arc flag, however, step 210 evaluates for a sparking condition. In this step, the precipitator voltage and current for the last half cycle is compared to the averages for the last eight half cycles. If the precipitator voltage has fallen or the precipitator current has risen in excess of that permitted by parameters Pll and P12, respectively, a spark is declared and step 216 is executed. In step 216, an off count is set to the number of half cycles determined by parameter P36 plus 2. Thus the precipitator will be off for several half cycles. If no spark occurred, however, the thyristor angle is fixed for the next half cycle in step 212.

Also, the time of spark occurrence is recorded so that the spark to spark delay can be calculated. At this time, instantaneous spark rates can be calculated as the inverse of this delay. For display purposes, the these instantaneous spark rates can be averaged and displayed. Because of the sparking conditions, the thyristor angle is reduced in accordance with parameter P13 in step 218. In step 220, the average precipitator current existing at sparktime is distinctly recorded.

Thereafter, previously mentioned step 222 is executed, followed by step 224; wherein the off count is checked. If the off count has expired, the arc flag is cleared in step 226. If not in a pulse modulated power mode, the current limit for precipitator operation is made more lenient in step 230. This feature allows for the relatively high current that can be expected after a precipitator has been off for some period of time due to a spark or an arc. This limit is imposed for a relatively short period of time that may be established in accordance with the parameters of the precipitator under control. Thereafter, in step 234, the thyristor angle is set for the forthcoming half cycle.

Figure 4D:
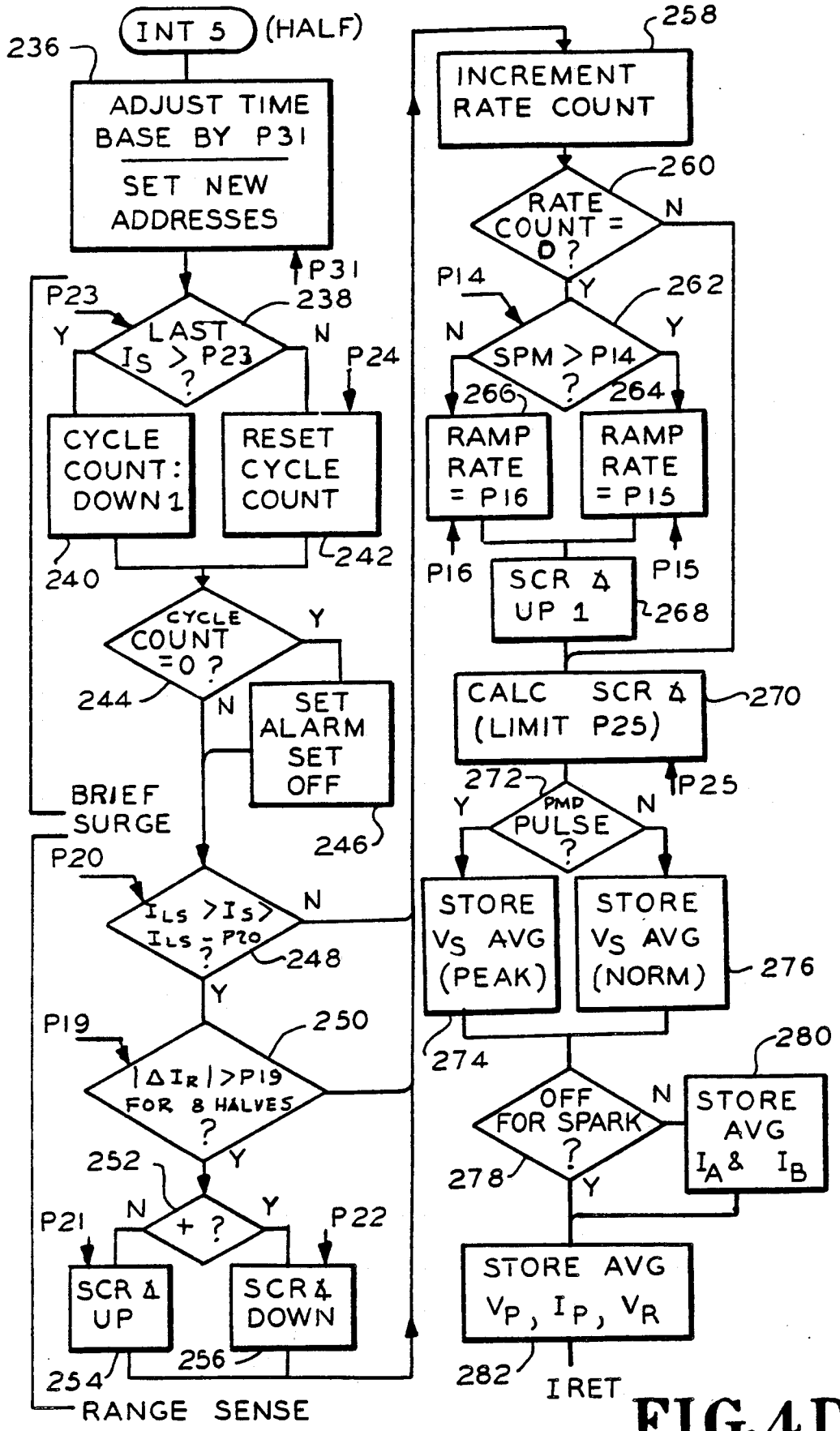
Figure 4E:
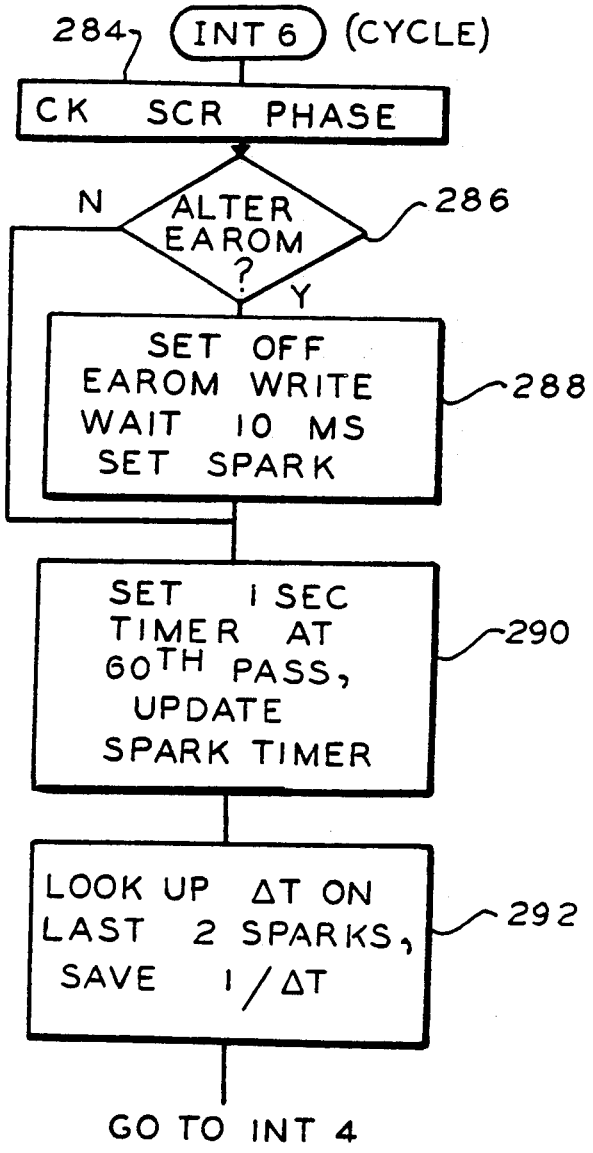

The interrupt handler of FIG. 4D is initiated by previously mentioned phase locked loop 56 of FIG. 2 at the end of a half cycle. In step 236, the time base for this handler is adjusted by the zero offset of parameter P31. This parameter adjust for the previously mentioned fact that the inductors feeding the transformer/rectifier cause a delay. Accordingly, parameter P31 adjusts the time base so that the timing is related to a true zero crossing. Also, in step 236, new addresses are selected for storing the waveform data for the next half cycle.

Steps 238–246 are designed to allow the system to tolerate a current surge for a limited time. In step 238, the average precipitator current of the last half cycle is compared against parameter P23. If not exceeded, a cycle counter is reset according to parameter P24 in step 242. Otherwise, the cycle count is decremented by one in step 240. If at step 244 the cycle count has been reduced to zero, an alarm is set in step 246. The cycle count should never reach zero unless the surge current of step 238 is exceeded for the number of half cycles determined by parameter P24.

Steps 248–256 is a range sensitive evaluation of the condition of the current through the conductors feeding the transformer/rectifier. In step 248, the precipitator current at the last spark is compared to the current of the last half cycle. If the current of the last half cycle is less than the current at the last spark, but not less than a range value determined by parameter P20, step 250 is executed. In step 250, the voltage across the inductor (either inductor L6 or L8 of FIG. 1) is evaluated to determine if it has changed in magnitude by an amount greater than parameter P19 over the last 8 half cycles. As with the back corona test, the latest value of reactor current can be compared to either an average of prior half cycles or against individual prior half cycles, or against some other trend pattern. If the reactor current is down, steps 252 and 254 increase the thyristor angle by parameter P21. Otherwise, in step P22, the thyristor angle is reduced in accordance with parameter P22.

This range sensing section is followed by step 258, where a rate counter is incremented. This rate counter establishes an interval after which the thyristor angle can be adjusted upwardly to produce an upwardly ramping precipitator drive. If this time interval has passed, step 260 transfers control to step 262 wherein the spark rate is evaluated. If the previously determined spark rate is in excess of parameter P14, the ramp rate count is set to parameter P15, a relatively gentle slop. Otherwise, the ramp rate counter is set to parameter P16 the normal ramp rate in step 266. Thereafter, in step 268, the thyristor angle is incremented one count to accomplish the ramping. If, however, it is not time to ramp the thyristor upwardly, step 260 would have diverted control directly to the next step, step 270.

In step 270 all of the various offsets and adjustments to the thyristor angle are calculated and are limited to the value of parameter P25. In the following step 272, depending upon whether the pulse modulation power mode is occurring, the precipitator voltage will be stored for subsequent display as either a peak value (step 274) or as the normal average value (step 276). According to conditional step 278, the average current for the two polarities of secondary current are stored only if there has not been a spark. If the system was shut down for a spark, there is no need to record the expected zero value. In step 282, the average of precipitator voltage and current and reactor voltage are stored. Thereafter, the interrupt handler returns control to the program of FIGS. 4A–B.

Figure 4F:
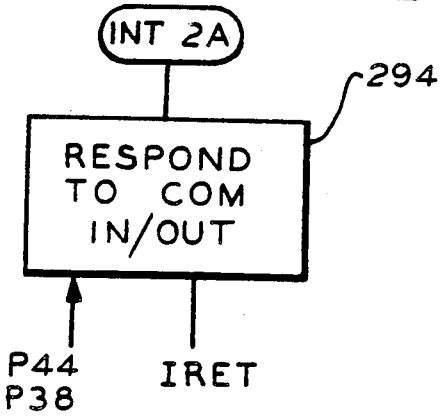

Interrupt handler INT6 of FIG. 4F occurs every cycle, that is, every 1/60 second, for a 60 Hz power line. In step 284, the polarity phasing of the thyristors is checked to make certain that the system has not inadvertently gotten 180 degrees out of phase. Step 286 is next used to bypass step 288 if the operator does not wish to alter the EAROM (memory 68 of FIG. 2). Otherwise, in step 288 the thyristors are set off and data is written into the EAROM. Thereafter, the system idles for 10 milliseconds. Then the previously mentioned off count is set as if a spark occurred.

Next in step 290, a real time timer is set to increment a one second elapsed time timer, if this is the 60th pass. Thereafter, the spark timers are updated. In step 292, the elapsed time between the last two sparks is calculated and saved as an inverse, that is, the instantaneous spark rate. This concludes the interrupt handler and control returns to the program of FIGS. 4A–B.

Referring to FIG. 4F, interrupt handler 2A is used to deal with communications such as the previously described communications with allied processors, such as processor 24 and 26 of FIG. 1. When a demand to send or receive communications is received, interrupt handler responds in step 294. The input parameter P38 defines a tag number for units that are communicating with the processor. Parameter P44 is used to set the protocol to an IBM protocol or an ISC intecolor protocol. The information being transferred between processors is not analyzed now but a response is developed in previously described step 294. Information is, however, stored for later processing in previously mentioned step 185.

It is to appreciated that various modifications may be implemented with respect to the above described preferred embodiments. For example, the previously mentioned flowchart can be modified by supplementing or reducing the software functions. Also, the order in which steps are performed can be changed in other embodiments. Furthermore, certain microprocessor functions can be assigned to or taken from an allied processor. Also, the scale of integration can be changed depending upon the suitability of existing components.

Similarly, the amount of memory can be altered depending upon the functions that are to be performed by the microcomputer. Also, the precipitator control scheme can be altered to respond in various ways to measured operating parameters, without departing from the scope of the invention. Similarly, more or fewer parameters than those illustrated can be measured by the microprocessor. Also, the central monitoring unit can employ personal computers, minicomputers or other systems of various types. Furthermore, the microprocessor is shown communicating with two allied processors and a central memory unit, but may, in other embodiments, communicate with more or fewer units. Furthermore, the communications can all be on a common data line where programing avoid collisions between units requesting access to the communications line. In addition, various components can be substituted for those illustrated, depending upon the desired speed, capacity, temperature stability, etc.

Obviously many modifications and variations of the present invention are possible in light of the above teachings. It is therefore to be understood that within the scope of the appended claims, the invention may be practiced otherwise than as specifically described.

What is claimed is:

1. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal;

measurement means coupled to said precipitator for providing a plurality of measurement signals corresponding to a plurality of operating parameters of said precipitator; and processing means having a program and being coupled to said measurement means and said power modulator for producing said control signal and for regulating said power modulator in response to said measurement signals, said processing means including:

spark concurrence means responsive to at least one of said measurement signals for spark synchronously storing a sparktime signal having a magnitude corresponding to a given one of said operating parameters, said sparktime signal being distinctly stored and designated as a signal occurring during a spark, said processing means being operable to vary said control signal in response to said sparktime signal.

2. A controller according to claim 1 wherein said processing means is operable to vary said control signal in a direction to drive said given one of said operating parameters toward a value having a predetermined relation to said sparktime signal.

3. A controller according to claim 1 further comprising:

a conductive element coupled to said power modulator and operative to conduct in response to variations in the extent to which said power modulator is transferring energy, said measurement means being coupled to said conductive element and operable to make a precursive one of its measurement signals correspond with the voltage across said conductive element, said processing means being operable if said given one of said measurement signals is within a predetermined range near said sparktime signal to vary said control signal in response to a predetermined variation in said precursive one of said measurement signals.

4. A controller according to claim 1 further comprising:

a remote monitoring unit for displaying a waveform from data samples, said processing means being operable to sample and send successive discrete values of at least one of said measurement signals occurring over a sampled interval to said remote monitoring unit for display.

5. A controller according to claim 4 wherein said successive discrete values are sent after said sampled interval and in less time than said sampled interval.

6. A controller according to claim 1 further comprising:

interrupt means coupled to said power modulator for providing to said processing means an interrupt signal responsive to said alternating current for interrupting the program of said processing means and synchronizing the control signal with said alternating current or a harmonic thereof.

7. A controller according to claim 6 further comprising:

converter means coupled to said processing means, said processing means being operable to provide to said converter means a digital output signal synchronized by said interrupt signal and signifying a variable duty cycle, said converter means being operable to convert said digital output signal to an analog signal; and utilization means coupled to said converter means for utilizing said analog signal.

8. A controller according to claim 6 wherein said power modulator includes:

switching means for chopping said alternating current.

9. A controller according to claim 8 wherein said control signal comprises an on/off signal for operating said switching means in real time.

10. A controller according to claim 8 wherein said switching means is a thyristor having a gate to both turn on and turn off said switching means.

11. A controller according to claim 1 wherein said spark concurrence means is operable to record an elapsed time between successive sparks.

12. A controller according to claim 11 wherein said processing means is operable to increase said control signal at a rate determined by said elapsed time.

13. A controller according to claim 1 wherein said measurement means is operable to make a flow sensing one of its measurement signals correspond with the current flowing to said precipitator from said power modulator, said processing means being operable to vary said control signal to limit said flow sensing one of said measurements to a variable standard, said variable standard being moderated for a predetermined time interval after spark detection by said spark concurrence means.

14. A controller according to claim 1 wherein said processing means is operable to successively sample sampled ones of said measurement signals over a plurality of half cycles of said alternating current, and to do averaging over said plurality of half cycles, said spark concurrence means being operable to detect sparking by detecting in one of said sampled ones a predetermined change in the average from the next half cycle as compared to the average over said plurality of half cycles.

15. A controller according to claim 14 wherein said processing means is operable to moderate said control signal in response to spark detection by said spark concurrence means.

16. A controller according to claim 1 wherein said power modulator comprises:

a full wave rectifier for converting alternating current to direct current, said rectifier having oppositely phased currents, said measurement means being coupled to said rectifier and operable to make a balance sensing pair of its measurement signals correspond with the oppositely phased currents, said processing means being operable to disable said control signal in response to a predetermined imbalance in said balance sensing pair.

17. A controller according to claim 1 wherein said measurement means is operable to make a voltage sensing one of its measurement signals correspond with precipitator voltage, said processing means being operable to reduce the control signal in response to the voltage sensing one of said measurement signals falling as the control signal rises in a given manner over a predetermined number of half cycles.

18. A controller according to claim 1 wherein said processing means comprises:

timing means coupled to said power modulator for detecting each zero crossing of the alternating current upstream of said power modulator and for providing at an operator adjustable time after said zero crossing an adjusted zero signal; and start means for switching said alternating current on at a time after said adjusted zero signal that is determined by said control signal.

19. A controller according to claim 1 wherein said measurement means is operable to make a current sensing one of its measurement signals correspond with precipitator current, said processing means being operable to turn off said power modulator in response to said current sensing one of said measurement signals exceeding a preset limit for more than a preset time interval.

20. A controller according to claim 19 wherein said preset time interval is a preset number of half cycles.

21. A controller according to claim 1 wherein said measurement means is operable to make a voltage sensing one and a current sensing one of its measurement signals correspond with precipitator voltage and current, respectively, said processing means being operable to turn off said power modulator in response to said voltage sensing one of said measurement signals being less than a predetermined limit and either (a) remaining less than said predetermined limit for a first time interval, or (b) said current sensing one of said measurement signals exceeding a preset restriction for a second time interval.

22. A controller according to claim 19 wherein said second time interval is a predetermined number of half cycles.

23. A controller according to claim 1 wherein said measurement means is operable to make a current sensing one of its measurement signals correspond with precipitator current, said processing means being operable to boost and suppress the control signal at a period that is a multiple of the half cycle duration of the alternating current, said processing means being operable to vary the control signal to limit said current sensing one of said measurement signals to an oscillating standard that is boosted and suppressed in synchronism with the boosting and suppression of said control signal.

24. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal;

measurement means coupled to said precipitator for providing a plurality of measurement signals corresponding to a plurality of operating parameters of said precipitator; and processing means having a program and being coupled to said measurement means and said power modulator for producing said control signal and for regulating said power modulator in response to said measurement signals, said processing means being operable to successively sample sampled ones of said measurement signals over a plurality of half cycles of said alternating current, and to do averaging over said plurality of half cycles, said processing means being operable to detect sparking by detecting in one of said sampled ones a predetermined change in the average from the next half cycle as compared to the average over said plurality of half cycles.

25. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal, said power modulator having a full wave rectifier for converting alternating current to direct current, said rectifier having oppositely phased currents;

measurement means coupled to said precipitator for providing a plurality of measurement signals corresponding to a plurality of operating parameters of said precipitator, said measurement means being coupled to said rectifier and operable to make a balance sensing pair of its measurement signals correspond with the oppositely phased currents; and processing means having a program and being coupled to said measurement means and said power modulator for producing said control signal and for regulating said power modulator in response to said measurement signals, said processing means being operable to disable said control signal in response to a predetermined imbalance in said balance sensing pair.

26. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal, said power modulator having a full wave rectifier for converting alternating current to direct current, said rectifier having oppositely phased currents;

measurement means coupled to said precipitator for providing a plurality of measurement signals corresponding to a plurality of operating parameters of said precipitator, said measurement means being operable to make a voltage sensing one of its measurement signals correspond with precipitator voltage; and processing means having a program and being coupled to said measurement means and said power modulator for producing said control signal and for regulating said power modulator in response to said measurement signals, said processing means being operable to reduce the control signal in response to the voltage sensing one of said measurement signals falling as the control signal rises in a given manner over a predetermined number of half cycles.

27. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal;

measurement means coupled to said precipitator for providing a plurality of measurement signals corresponding to a plurality of operating parameters of said precipitator; and processing means having a program and being coupled to said measurement means and said power modulator for producing said control signal and for regulating said power modulator in response to said measurement signals, said processing means including:

timing means coupled to said power modulator for detecting each zero crossing of the alternating current upstream of said power modulator and for providing at an operator adjustable time after said zero crossing an adjusted zero signal, said power modulator including:

start means for switching said alternating current on at a time after said adjusted zero signal that is determined by said control signal.

28. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal;

measurement means coupled to said precipitator for providing a plurality of measurement signals corresponding to a plurality of operating parameters of said precipitator, said measurement means being operable to make a current sensing one of its measurement signals correspond with precipitator current; and processing means having a program and being coupled to said measurement means and said power modulator for producing said control signal and for regulating said power modulator in response to said measurement signals, said processing means being operable to turn off said power modulator in response to said current sensing one of said measurement signals exceeding a preset limit for more than a preset time interval.

29. A controller according to claim 28 wherein said preset time interval is a preset number of half cycles.

30. A controller according to claim 28 wherein said measurement means is operable to make a voltage sensing one and a current sensing one of its measurement signals correspond with precipitator voltage and current, respectively, said processing means being operable to turn off said power modulator in response to said voltage sensing one of said measurement signals being less than a predetermined limit and either (a) remaining less than said predetermined limit for a first time interval, or (b) said current sensing one of said measurement signals exceeding a preset restriction for a second time interval.

31. A controller according to claim 30 wherein said second time interval is a predetermined number of half cycles.

32. A controller according to claim 28 wherein said measurement means is operable to make a current sensing one of its measurement signals correspond with precipitator current, said processing means being operable to boost and suppress the control signal at a period that is a multiple of the half cycle duration of the alternating current, said processing means being operable to vary the control signal to limit said current sensing one of said measurement signals to an oscillating standard that is boosted and suppressed in synchronism with the boosting and suppression of said control signal.

33. A controller for controlling a precipitator, said controller being operable to communicate with an allied processor, said allied processor being operable to direct another physical process and to transfer information by means of allied signals, said controller comprising:

a power modulator having a control terminal and being coupled to said precipitator, said power modulator being operable to regulate the drive to said precipitator in response to a control signal on said control terminal;

measurement means coupled to said precipitator for providing at least one measurement signal corresponding to an operating parameter of said precipitator;

processing means coupled to said measurement means and said power modulator for producing said control signal and regulating said power modulator in response to said measurement signal; and a communications port coupled to said processing means and said allied processor for transferring between them said allied signals, said allied signals being relevant to said precipitator.

34. A controller according to claim 33 wherein said processing means is operable to transmit through said communications port to said allied processor said command signal having an anticipatory significance and signifying the extent to which said precipitator is driven, so that said allied processor can be regulated by the power level of said precipitator.

35. A controller according to claim 34 wherein said allied processor controls an allied precipitator system that is downstream of said precipitator, said command signal with said anticipatory significance being timed to enable said allied precipitator system to vary its power in anticipation of a change in downstream demand anticipated by said command signal with said anticipatory significance.

36. A controller according to claim 34 wherein said allied processor controls a conditioning system for conditioning with a conditioning medium the gas entering said precipitator, said processing means being operable to provide said command signal with said anticipatory significance when said measurement signal indicates a need for a rate change in the conditioning medium entering said precipitator.

37. A controller according to claim 33 wherein said processing means is operable to vary said control signal in response to said allied signals from said allied processor.

38. A controller according to claim 37 wherein said allied processor controls an allied precipitator system and is operable to provide to said communications port said command signal with an anticipatory significance and signifying a power increase for said allied precipitator system, said processing means being operable through said power modulator to increase the drive to said precipitator in response to said command signal with said anticipatory significance.

39. A controller according to claim 37 wherein said allied processor controls a conditioning system for conditioning with a conditioning medium the gas entering said precipitator, said allied processor being operable to provide said command signal with an anticipatory significance and signifying a predetermined rate change for said conditioning medium, said processing means being operable through said power modulator to vary the drive to said precipitator in response to said command signal with said anticipatory significance.

40. A controller according to claim 39 wherein said processing means is operable to change said control signal before the predetermined rate change ordered by said allied processor.

41. A controller according to claim 39 wherein said allied processor is operable to provide said command signal with an advanced significance signifying increased opacity in the gas leaving said precipitator, said processing means being operable through said power modulator to vary the drive to said precipitator in response to said command signal with said advanced significance.

42. A controller according to claim 37 wherein said allied processor controls a conditioning system for conditioning with a conditioning medium the gas entering said precipitator, said allied processor being operable to provide said command signal with a diagnostic significance, said processing means being operable in response to said command signal with said diagnostic significance to vary the drive to said precipitator in a predetermined manner and to transmit through said communications port a parameter signal signifying the changing voltage and current in said precipitator, so that the voltage-current characteristic of said precipitator can be evaluated by said allied processor.

43. A controller according to claim 33 wherein said power modulator is adapted to be powered by an alternating current, said processing means being operable to monitor said measurement signal over an interval which is a multiple of half of the period of said alternating current, to calculate a character value corresponding to a time-dependent characteristic of said measurement signal.

44. A controller according to claim 43 wherein said time dependent characteristic is a time average calculated by said processing means.

45. A controller according to claim 43 wherein said time dependent characteristic is an extreme value.

46. A controller for controlling a precipitator, comprising:

a power modulator having a control terminal and being coupled to said precipitator, said power modulator being adapted to be powered by an alternating current, said power modulator being operable to regulate the drive to said precipitator in response to a control signal on said control terminal;

measurement means coupled to said precipitator for providing at least one measurement signal corresponding to an operating parameter of said precipitator;

processing means having a program and being coupled to said measurement means and said power modulator for producing said control signal and for regulating said power modulator in response to said measurement signal; and interrupt means coupled to said power modulator for providing to said processing means an interrupt signal responsive to said alternating current for interrupting the program of said processing means and synchronizing the control signal with said alternating current.

47. A controller according to claim 46 further comprising:

converter means coupled to said processing means, said processing means being operable to provide to said converter means a digital output signal synchronized by said interrupt signal and signifying a variable duty cycle, said converter means being operable to convert said digital output signal to an analog signal; and utilization means coupled to said converter means for utilizing said analog signal.

48. A method for controlling a precipitator and communicating with an allied processor, said allied processor being operable to direct another physical process and to transfer information, comprising the steps of:

measuring at least one operating parameter of said precipitator;

regulating the drive to said precipitator in response to said operating parameter; and transferring with respect to said allied processor information relevant to said precipitator.

49. A method according to claim 48 wherein said processing means is operable to transmitting to said allied processor a command signal having an anticipatory significance and signifying the extent to which said precipitator is driven; and controlling said allied processor by the power level of said precipitator.

50. A method according to claim 49 wherein said allied processor controls an allied precipitator system that is downstream of said precipitator, the method including the step of:

timing said command signal with said anticipatory significance to enable said allied precipitator system to vary its power in anticipation of a change in downstream demand anticipated by said command signal with said anticipatory significance.

51. A method according to claim 49 wherein said allied processor controls a conditioning system for conditioning with a conditioning medium the gas entering said precipitator, the method including the step of:

providing said command signal with said anticipatory significance when said operating parameter indicates a need for a rate change in the conditioning medium entering said precipitator.

52. A method according to claim 48 including the step of:

varying said control signal in response to allied signals from said allied processor.

53. A method according to claim 52 wherein said allied processor controls an allied precipitator system and is operable to transmit said command signal with an anticipatory significance and signifying a power increase for said allied precipitator system, the method includes the step of:

increasing the drive to said precipitator in response to said command signal with said anticipatory significance.

54. A method according to claim 52 wherein said allied processor controls a conditioning system for conditioning with a conditioning medium the gas entering said precipitator, said allied processor being operable to provide said command signal with an anticipatory significance and signifying a predetermined rate change for said conditioning medium, the method includes the step of:

altering the drive to said precipitator in response to said command signal with said anticipatory significance.

55. A method according to claim 54 wherein said processing means is operable to change said control signal before the predetermined rate change ordered by said allied processor.

56. A method according to claim 54 wherein said allied processor is operable to provide said command signal with an advanced significance signifying increased opacity in the gas leaving said precipitator, the method includes the step of:

changing the drive to said precipitator in response to said command signal with said advanced significance.

57. A method according to claim 52 wherein said allied processor controls a conditioning system for conditioning with a conditioning medium the gas entering said precipitator, said allied processor being operable to provide said command signal with a diagnostic significance, the method including the step of:

modulating the drive to said precipitator in response to said command signal with said diagnostic significance in a predetermined manner; and sending to said allied processor a parameter signal signifying the changing voltage and current in said precipitator, so that the voltage-current characteristic of said precipitator can be evaluated by said allied processor.

58. A method according to claim 48 comprising the step of:

remitting to said allied processor successive discrete values of said operating parameter occurring over a sampled interval.

59. A method according to claim 50 wherein said successive discrete values are sent after said sampled interval and in less time than said sampled interval.

* * * * *